United States Patent [19]

Rankin

[11] Patent Number: 4,824,140

[45] Date of Patent: Apr. 25, 1989

[54] WRIST NOTE PAD

[76] Inventor: Virginia W. Rankin, 11 Half Moon Bend, Coronado, Calif. 92118

[21] Appl. No.: 187,973

[22] Filed: Apr. 29, 1988

[51] Int. Cl.[4] ..... B42D 19/00; B41L 31/00; G09F 11/18; B42F 17/28

[52] U.S. Cl. ..... 281/8; 281/6; 40/385; 40/518

[58] Field of Search ..... 281/2, 5, 6, 7, 8, 11; 434/88, 436; 40/21 C, 385, 518

[56] References Cited

U.S. PATENT DOCUMENTS

| | | | |
|---|---|---|---|
| 2,224,470 | 12/1940 | Boust | 281/5 |
| 2,546,483 | 3/1951 | Venters | 281/7 |
| 2,680,628 | 6/1954 | Berman | 281/6 |
| 2,691,535 | 10/1954 | Schell | 281/6 |
| 4,083,136 | 4/1978 | Zelenko | 281/8 |

FOREIGN PATENT DOCUMENTS

| | | | |
|---|---|---|---|
| 76105 | 11/1917 | Switzerland | 281/8 |

*Primary Examiner*—Frank T. Yost
*Assistant Examiner*—Paul M. Heyrana, Sr.
*Attorney, Agent, or Firm*—Charles C. Logan II

[57] ABSTRACT

The wrist note pad has an elongated housing having its respective ends pivotally connected to the opposite ends of a wrist fastening band. Within the housing is a scrolled paper roll journaled adjacent its one end and a take-up roll shaft journaled adjacent its opposite end. A rewind knob and a paper feed knob are both positioned outside of the housing and are connected to the respective scrolled paper roll and take-up roll shaft positioned within the housing. A writing surface cover is attached by a hinge to the top surface of the wrist note pad and it has a pair of longitudinally spaced laterally extending slots therein through which the scrolled paper would be threaded to provide a writing surface atop the cover.

1 Claim, 1 Drawing Sheet

WRIST NOTE PAD

BACKGROUND OF THE INVENTION

The invention relates to a writing note pad and more specifically to one that can be worn upon the wrist of a person.

There are many instances when a person is in need of a piece of paper in order to take notes and such paper is simply not available or a large note pad is inconvenient to carry around. Lacking such a note pad, people have to resort to their memory for recall when writing a note would have been beneficial. There are instances when a person planning a shopping trip may wish to make a list of things to purchase and a note pad can be an inconvenience. Other examples of need for a note pad are: speakers at podiums where looking at notes tie them to the podium; sports enthusiasts, such as golfers, may wish to keep score while indulging in the sport; field engineers where sketches or diagrams of a problem is needed; night watchmen may wish to record unusual occurences or locks and numbers that need follow up work; business men on trips or waitresses recording orders and tip income. Lists are frequently needed by everyone from time to time and occasions where a piece of paper would be beneficial are numerous.

The invention provides an inconspicuous way of making written recordings, lists of things to do and providing on-the-spot documentation of important numbers, illustrations and notes.

There is, therefore, a need for a simple to use and inexpensive means of taking notes. The invention provides a highly accesible, inconspicuous note taking system with an easily stored permanent record for later referral.

SUMMARY OF THE INVENTION

Applicant's device enables the user to take notes or make illustrations as a means of later referral. The invention is a small scrolling note pad which is worn upon the users wrist in such a manner so as to allow the user to write upon the writing surface of invention and record notes, numbers or illustrations as required by the wearer of the device. The purpose of the invention is to provide the means for the owner to have a ready access to a small, scrolling pad of paper to write upon and then later re-read the notes or provide a log of an activity.

The wrist note pad has a wrist band such as those found with common wrist watches. The housing of the device provides a chamber within which a small scrolled paper roll is journaled. A take-up roll is also journaled in the housing. Small finger knobs located outside of the housing adjacent one of its side walls function to control take-up tension and feed control of the scrolled paper. The writing surface cover plate is hinged to the top of the housing and it has two longitudinally spaced laterally extending slots through which the scrolled paper is passed.

When properly loaded, the device will have a scroll of paper on the feed roll and its free end would be threaded upwardly through one of the slots in the writing surface cover, across its length, and down through the other slot in the writing surface cover where the free end would be threaded into the take-up roll shaft. By turning the paper feed knob, the user causes the paper to scroll across the top surface of the writing surface cover. As notes, numbers or drawings are made, simpling scrolling the paper provides a new writing surface and saves the paper on the take-up roll shaft.

As a continuing source of supply for the device, the scrolled paper rolls would be sold in packets such as a six-pack, to provide the users of the device a continual source of paper. The packets would be sold independently of the wrist note pad.

DESCRIPTION OF THE PREFERRED EMBODIMENT

Figure 1:
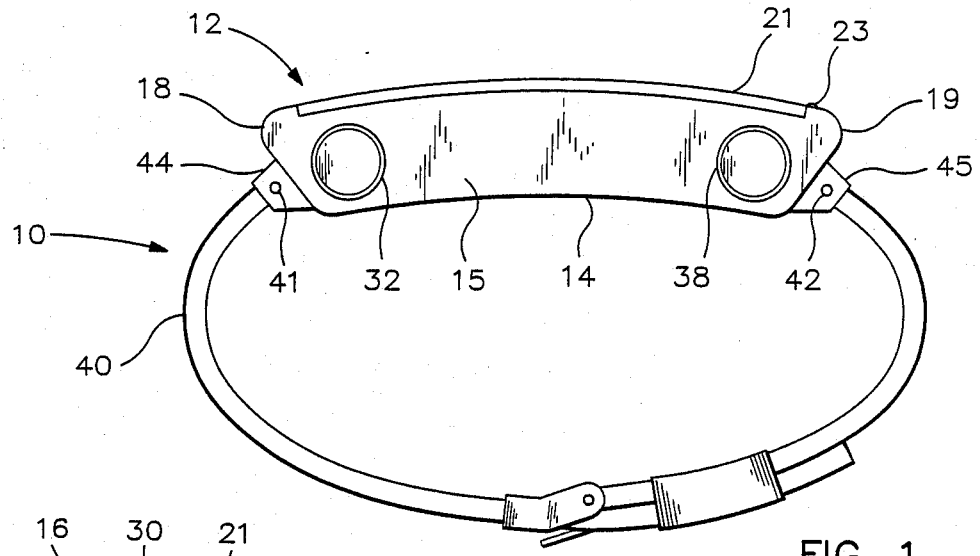
FIG. 1 is a side elevation view of applicant's novel wrist note pad.
Figure 2:
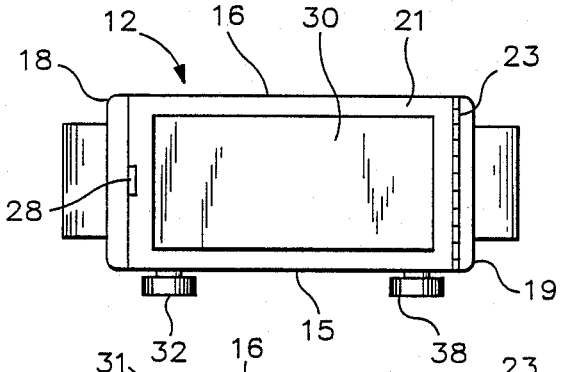
FIG. 2 is a top plan view of the novel wrist note pad.
Figure 3:
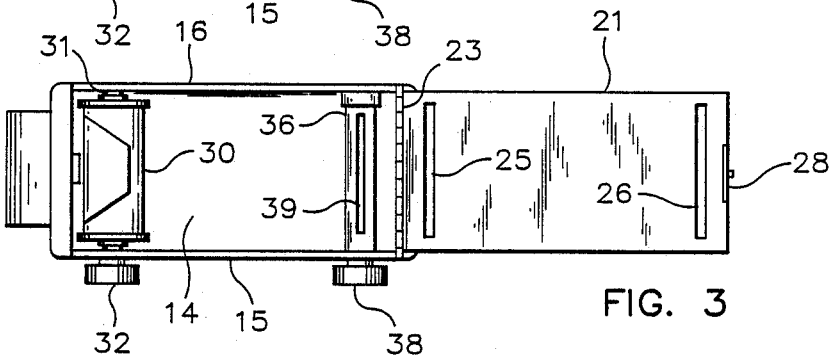
FIG. 3 is a top plan view of the novel wrist note pad with the writing surface cover in its open position.
Figure 4:
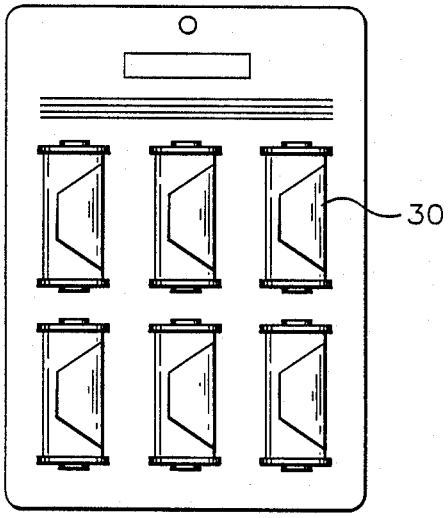
FIG. 4 is a top plan view of a six-pack of scrolled paper rolls.
Figure 5:
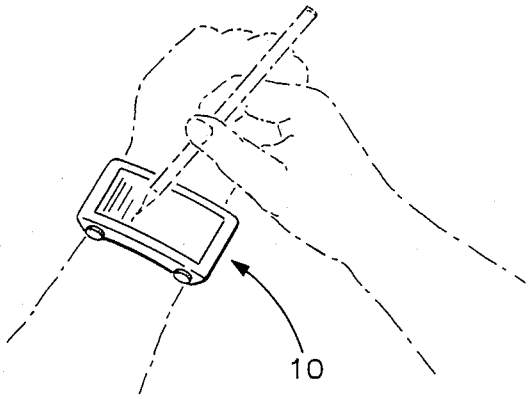
FIG. 5 is a perspective view illustrating the novel wrist note pad worn on a persons wrist.

Applicant's invention will now be described by referring to FIGS. 1–5 of the drawing. The wrist note pad is generally designated numeral 10.

Wrist note pad 10 has a housing 12 having a bottom wall 14, lateral side walls 15 and 16, and end walls 18 and 19. A writing surface cover 21 is attached by a hinge 23 to the top of housing 12. Laterally extending slots 25 and 26 are formed adjacent the opposite ends of writing surface cover 21. A snap clip 28 is attached to one end of writing surface cover 21.

A scrolled paper roll 30 has its opposite ends journaled within housing 12. A feed roll shaft 31 extends through side wall 15 and is detachaby engagable with one of the scrolled paper rolls 30. A rewind knob 32 is mounted on feed roll shaft 31. A take up roll shaft 36 has at its opposite ends journaled in housing 12 and a paper feed knob 38 is attached to its one end. An axially extending slot 39 is formed in take-up roll 36 for receiving the forward end tab portion of the scrolled paper roll 30.

A wrist fastening band 40 has its opposite ends pivotally connected to pins 41 and 42 that are detachably received in brackets 44 and 45 respectively.

The figures shown in the drawing and thusly described are the preferred embodiment of the invention. It would be obvious to one skilled in the art that various modifications and changes, simple or complex, could be made to the preferred embodiment which would change the appearance of the invention but not the scope, spirit and the intention of the invention. It is the intention of the invention to preclude the occurence of such modifications in design to the preferred embodiment through the following claims.

What is claimed is:

1. A wrist note pad comprising:

an elongated housing having a bottom wall, laterally spaced upstanding side walls and laterally spaced upstanding end walls that form a chamber therewithin, the bottom wall of said housing having a concave curvature to better mate with the wrist of the person wearing the wrist note pad;

a scrolled paper roll;

means for rotatably mounting said scrolled paper roll within said housing adjacent one of said end walls;

a take-up roll shaft, and take-up roll shaft having a longitudinally extending slot through which the front end of said scrolled paper roll would be threaded;

means for rotatably mounting said take-up roll shaft within said housing adjacent its other end wall;

an elongated writing surface cover for closing the top of said housing, said cover having a top surface and a bottom surface, said cover having longitudinally spaced laterally extending slots through which paper from scrolled paper roll can be threaded to overlay the top surface of said cover so that said paper may be written upon, the top surface of said cover having a convex curvature, one end of said writing surface is attached by a hinge to the top surface of said housing and the other end of said writing surface cover has a snap clip thereon for locking said writing surface cover;

an elongated wrist fastening band having first and second ends; and means for pivotally connecting the first and second ends of said wrist fastening band to the respective opposite ends of said housing.

* * * * *